US005743462A

United States Patent [19]

Stone

[11] Patent Number: 5,743,462

[45] Date of Patent: Apr. 28, 1998

[54] NESTABLE BLANK FOR FORMING A SIDE-FILLED, FLIP-TOP RECLOSABLE CARTON

[75] Inventor: James L. Stone, Grand Rapids, Mich.

[73] Assignee: Tenneco Packaging, Evanston, Ill.

[21] Appl. No.: 563,609

[22] Filed: Nov. 28, 1995

Related U.S. Application Data

[63] Continuation-in-part of Ser. No. 501,996, Jul. 13, 1995, Pat. No. 5,505,374.

[51] Int. Cl.[6] ..... B65D 5/06

[52] U.S. Cl. ..... 229/227; 229/145; 229/226; 229/933

[58] Field of Search ..... 229/145, 154, 229/226, 227, 905, 933

[56] References Cited

U.S. PATENT DOCUMENTS

| | | | |
|---|---|---|---|
| Re. 26,471 | 10/1968 | Meyers . | |
| 1,017,728 | 2/1912 | Bartlett . | |
| 2,348,377 | 5/1944 | Goodyear . | |
| 2,367,476 | 1/1945 | Tyrseck . | |
| 2,369,387 | 2/1945 | Williamson et al. . | |
| 2,369,392 | 2/1945 | Ringler . | |
| 2,396,310 | 3/1946 | Yungblut . | |
| 2,403,698 | 7/1946 | Williamson et al. . | |
| 2,717,074 | 9/1955 | Williamson et al. . | |
| 2,836,343 | 5/1958 | Will . | |
| 2,881,967 | 4/1959 | Ringler . | |
| 2,951,627 | 9/1960 | Wenzel . | |
| 3,140,809 | 7/1964 | Hickin et al. . | |
| 3,206,099 | 9/1965 | Fanter et al. | 229/933 |
| 3,207,416 | 9/1965 | Koltz et al. . | |
| 3,432,090 | 3/1969 | Engel . | |
| 3,524,581 | 8/1970 | Buttery . | |
| 3,708,108 | 1/1973 | Rosenbure, Jr. . | |
| 3,756,501 | 9/1973 | Skillen et al. . | |
| 3,910,486 | 10/1975 | Stone . | |
| 3,963,173 | 6/1976 | Stone . | |
| 4,048,052 | 9/1977 | Tolaas . | |
| 4,072,263 | 2/1978 | Focke | 229/933 |
| 4,083,455 | 4/1978 | Keating, Jr. . | |
| 4,102,457 | 7/1978 | Meyers . | |
| 4,127,229 | 11/1978 | Roccaforte . | |
| 4,141,449 | 2/1979 | Stone . | |
| 4,284,193 | 8/1981 | Roccaforte . | |
| 4,289,239 | 9/1981 | Meyers . | |
| 4,314,643 | 2/1982 | Forbes, Jr. . | |

(List continued on next page.)

FOREIGN PATENT DOCUMENTS

| | | |
|---|---|---|
| 1017728 | 9/1977 | Canada . |
| 1323608 | 10/1993 | Canada . |
| 2229996 | 3/1990 | United Kingdom . |

*Primary Examiner*—Gary E. Elkins
*Attorney, Agent, or Firm*—Arnold, White & Durkee

[57] ABSTRACT

A nested blank arrangement comprises first and second unitary, continuous blanks each for forming a side-filled, flip-top reclosable carton having opposing top and bottom walls, opposing front and back walls, and opposing first and second side walls. Each blank includes at least five panels hingedly connected to each other along generally horizontal fold lines. Each panel includes opposing first and second vertical edges. In order of connection, the panels include an inner front panel, a bottom panel, a back panel, a top panel, and an outer front panel. First and second side closure flaps are hingedly connected to each of the panels along the respective first and second vertical edges. The first and second side closure flaps cooperate to form the opposing first and second side walls of the carton. The first and second blanks are vertically oriented in opposite directions and are horizontally adjacent to each other. One or more of the first side closure flaps of the first blank horizontally nest with and border on one or more of the first side closure flaps of the second blank such that a horizontal distance between the first vertical edges of the first blank and the first vertical edges of the second blank is less than twice a horizontal dimension of the first side closure flap having a largest horizontal dimension.

19 Claims, 11 Drawing Sheets

U.S. PATENT DOCUMENTS 4,531,669 7/1985 Osborne .
4,542,847 9/1985 Lindstrom .
4,679,694 7/1987 Donohie et al. .
4,688,677 8/1987 Roccaforte .
4,726,471 2/1988 Whately et al. .
4,732,315 3/1988 Gunn .
4,768,703 9/1988 Sosler et al. .
4,773,542 9/1988 Schillinger et al. .
4,948,038 8/1990 Moeller .
4,986,420 1/1991 Gunn et al. .
5,092,516 3/1992 Kastanek .
5,148,973 9/1992 Zimmermann .
5,154,343 10/1992 Stone .
5,161,734 11/1992 Ruehl et al. .
5,209,394 5/1993 Griffiths et al. .
5,219,089 6/1993 Kiolbasa et al. .
5,236,123 8/1993 Stone et al. .
5,238,179 8/1993 Hart .
5,265,799 11/1993 Stone .
5,277,360 1/1994 DeMott .
5,299,732 4/1994 Armor et al. .
5,314,114 5/1994 Stone .
5,320,279 6/1994 Giblin et al. .
5,322,215 6/1994 Roccaforte .
5,328,091 7/1994 Koss .
5,373,960 12/1994 Gunn et al. .
5,439,133 8/1995 Stone .
5,460,321 10/1995 Focke ..... 229/933
5,553,771 9/1996 Correll ..... 229/933

Fig. 1
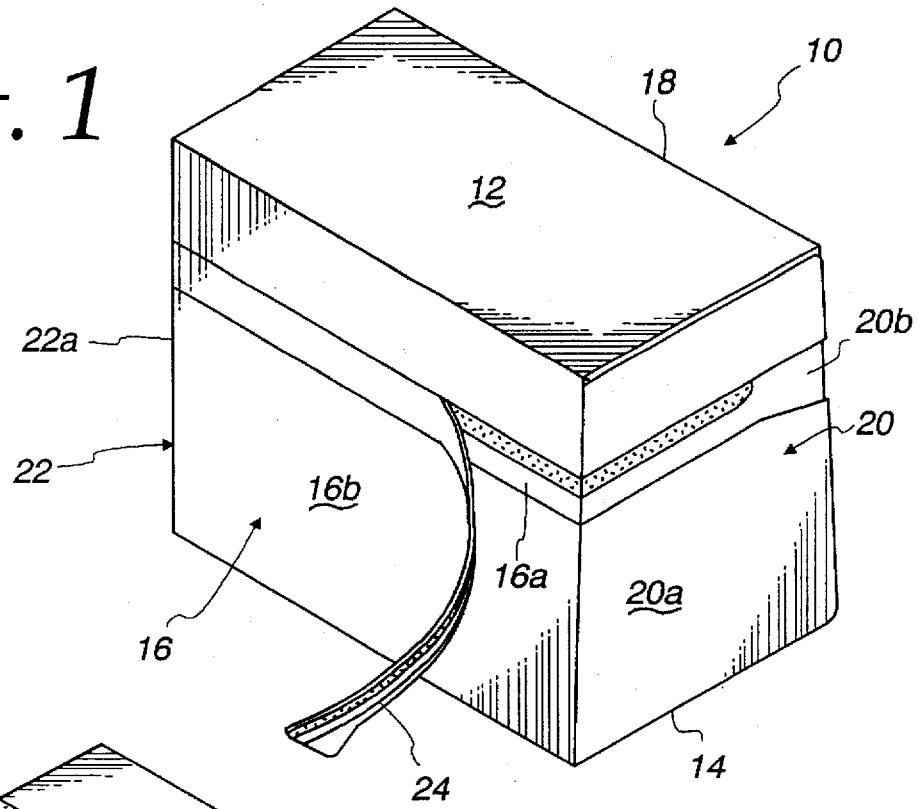
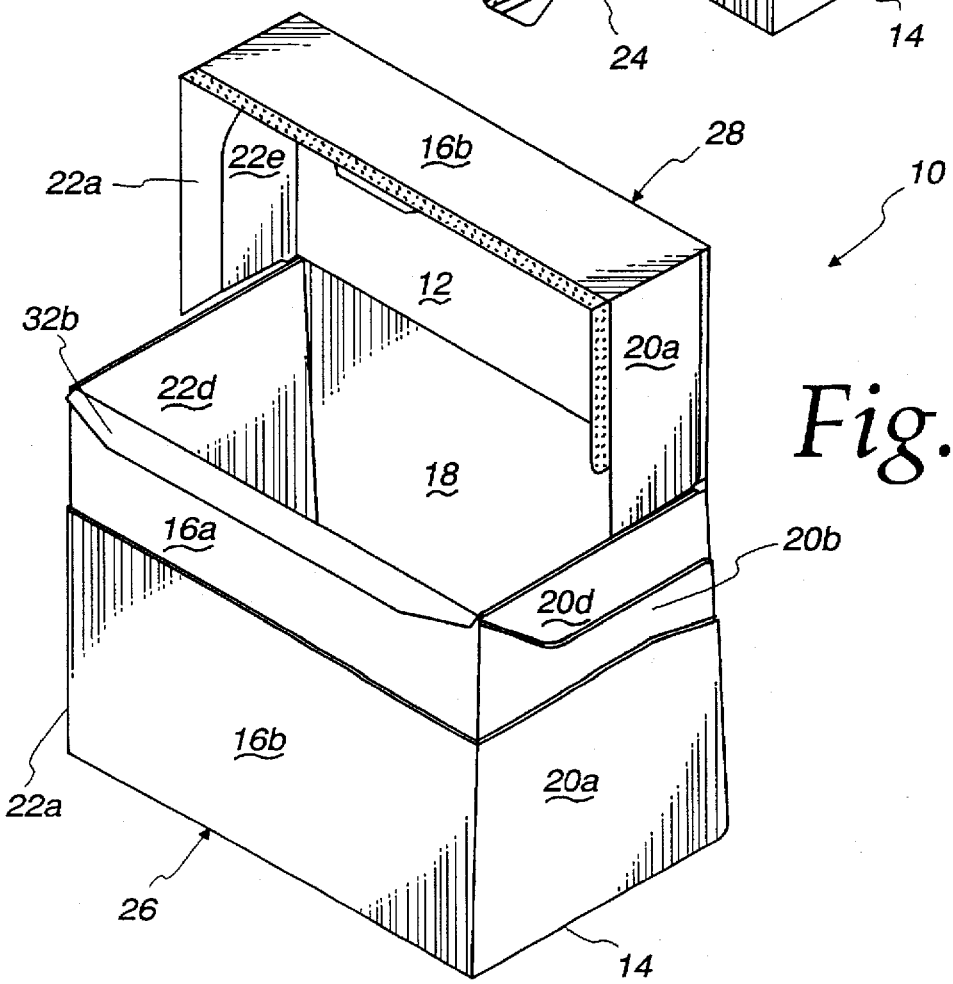
Fig. 2

NESTABLE BLANK FOR FORMING A SIDE-FILLED, FLIP-TOP RECLOSABLE CARTON

CROSS-REFERENCE TO RELATED APPLICATIONS

This application is a continuation-in-part of U.S. patent application Ser. No. 08/501,996, filed Jul. 13, 1995, and entitled "Flip-Top Reclosable Carton and Method of Making the Same", U.S. Pat. No. 5,505,374.

FIELD OF THE INVENTION

The present invention relates generally to flip-top reclosable cartons particularly adapted to storing powdered or granular materials. More specifically, the present invention relates to a nestable blank for forming a side-filled, flip-top reclosable carton.

BACKGROUND OF THE INVENTION

In a variety of consumer packaging applications, it is important to supply paperboard or corrugated cardboard cartons which are capable of being conveniently, yet securely, opened and reclosed repeatedly. The ability to be repeatedly opened and closed down in a lockable manner is particularly important where the carton is used for storage of granular or powdered material, such as laundry detergent powder. Various approaches have been undertaken to address the repeated opening and closing requirements by means of carton designs using different types of interlocking flaps.

An exemplary reclosable carton design is disclosed in U.S. Pat. No. 5,154,343 to Stone ("Stone"). Stone discloses a flip-top reclosable carton which employs an integral tear strip as means by which a user may strip open the carton. Removing the tear strip delineates the carton into a lid and a base, where the lid is hingedly connected to a back wall of the base. After the tear strip is removed, the carton is opened by lifting the lid up. Subsequently, the carton is reclosed by pushing the lid back down to its original position. Repeated closing and positive locking of the carton is realized by means of snap engagement of a distal attachment portion on the lid and a proximal locking portion on the base.

In another carton design, locking of the lid and base is realized by a friction fit between the lid and a corresponding engaging portion of the carton base.

Paperboard or corrugated cardboard cartons are typically formed from rolls or sheets of board which are cut into "blanks." Score lines are scribed between sections of a blank to divide the blank into rectangular sections and to facilitate folding of these sections with respect to one another. In forming a carton from the blank, a top, side, or bottom panel of the carton is initially left unsealed so that the carton may be filled with a product through the unsealed panel. Once the carton is filled with the product, the carton is sealed and the filled carton is ready to be sold to a consumer.

It is expected that side-filled cartons will become more ubiquitous than ever before in the granular detergent industry. Side-filled cartons offer several advantages over top-filled or bottom-filled cartons. For example, side-filled cartons are more capable of providing top load compression strength in the absence of elaborate strength-enhancing features. Also, side-filled, flip-top reclosable cartons are more easily manufactured from a unitary, continuous blank while keeping the amount of board material in the blank to a minimum.

The flip-top reclosable carton disclosed in Stone is an exemplary side-filled carton which is filled with a product through an unsealed side wall. Each side wall of the carton in Stone, for example, is created from top and bottom minor flaps, a back major flap, and a pair of overlapping front major flaps. One of the front major flaps is associated with a front inner panel, while the other of the front major flaps is associated with a front outer panel. In one version, the foregoing flaps are folded inward by 90 degrees in the following sequence: bottom minor flap, back major flap, pair of overlapping front major flaps, and top minor flap.

Typically, a die-cutting machine cuts and scores a web of board into several blanks at the same time. For example, the die-cutting machine may be sufficiently large to cut and score a single web of board into four adjacent blanks. The unused board material of the web located between the adjacent blanks is scrap material which is either discarded or recycled. In order to reduce the cost of producing canons from the blanks, it is desirable to minimize the amount of board in the blanks. The cost of the board material contributes significantly to the total cost of producing the cartons. Additionally, while die-cutting the web of board into multiple adjacent blanks, it is desirable to form the blanks as close to each other as possible. Not only does this reduce the amount of scrap material, but this also can increase the number of blanks which are simultaneously formed from the web by the die-cutting machine. The die-cutting machine might be able to accommodate more blanks at the same time if the blanks are more congested and occupy a smaller area. Increasing the number of blanks formed by the die-cutting machine at the same time, in turn, improves the throughput of the die-cutting machine. If, for example, the die-cutting machine processes five blanks at the same time instead of processing four blanks at the same time, the throughput of the die-cutting machine is increased by 25 percent.

Thus, by minimizing the amount of board employed in each blank and by maximizing the number of blanks which are simultaneously processed by the die-cutting machine, the cost of producing the cartons can be minimized and the capacity of the die-cutting machine can be optimized.

SUMMARY OF THE INVENTION

The present invention provides a nestable blank for forming a side-filled, flip-top reclosable carton. The nestable blank realizes the aforementioned objectives of minimizing the amount of board employed in each blank and maximizing the number of blanks which can be simultaneously processed by a die-cutting machine.

The unitary, continuous nestable blank is used to form a side-filled, flip-top reclosable carton having opposing top and bottom walls, opposing front and back walls, and opposing first and second side walls. The blank includes at least five panels hingedly connected to each other along generally horizontal fold lines. Each of the panels includes opposing first and second vertical edges. The panels include inner and outer front panels for forming the front wall; a back panel for forming the back wall; a top panel for forming the top wall; and a bottom panel for forming the bottom wall. The inner front panel is connected to the bottom panel, the bottom panel is connected to the back panel, the back panel is connected to the top panel, and the top panel is connected to the outer front panel.

The blank further includes first and second side closure flaps hingedly connected to each of the foregoing panels along the respective first and second vertical edges. The first and second side closure flaps of the panels cooperate to form the opposing first and second side walls of the carton. In one embodiment, the side closure flaps include first and second inner front major flaps hingedly connected to the inner front panel; first and second bottom minor flaps hingedly connected to the bottom panel; first and second back major flaps hingedly connected to the back panel; first and second top minor flaps hingedly connected to the top panel; and first and second outer front major flaps hingedly connected to the outer front panel. The blank is symmetrical about a vertical axis of symmetry passing through a center of each panel.

If the aforementioned blank is denoted as a first blank vertically oriented in a first direction, the first blank is designed to be nested with a second identical blank vertically oriented in a second direction opposite to the first direction. When the first and second blanks are nested with each other, one or more of the first side closure flaps of the first blank horizontally nest with and border on one or more of the first side closure flaps of the oppositely-directed second blank such that a horizontal distance between the first vertical edges of the first blank and the first vertical edges of the second blank is less than twice a horizontal dimension of the first side closure flap having a largest horizontal dimension. The first and second blanks may be vertically offset (staggered) relative to each other by a vertical distance which is less than a vertical dimension of the first side closure flap having a largest vertical dimension.

The above summary of the present invention is not intended to represent each embodiment, or every aspect, of the present invention. This is the purpose of the figures and the detailed description which follow.

BRIEF DESCRIPTION OF THE DRAWINGS

Other objects and advantages of the invention will become apparent upon reading the following detailed description and upon reference to the drawings in which:

FIG. 1 is a perspective view of a reclosable carton in its closed form with a tear strip partially removed;

FIG. 2 is a perspective view of the reclosable carton in FIG. 1, showing the carton in its opened form with a lid raised upwardly from a base section;

Figure 3:
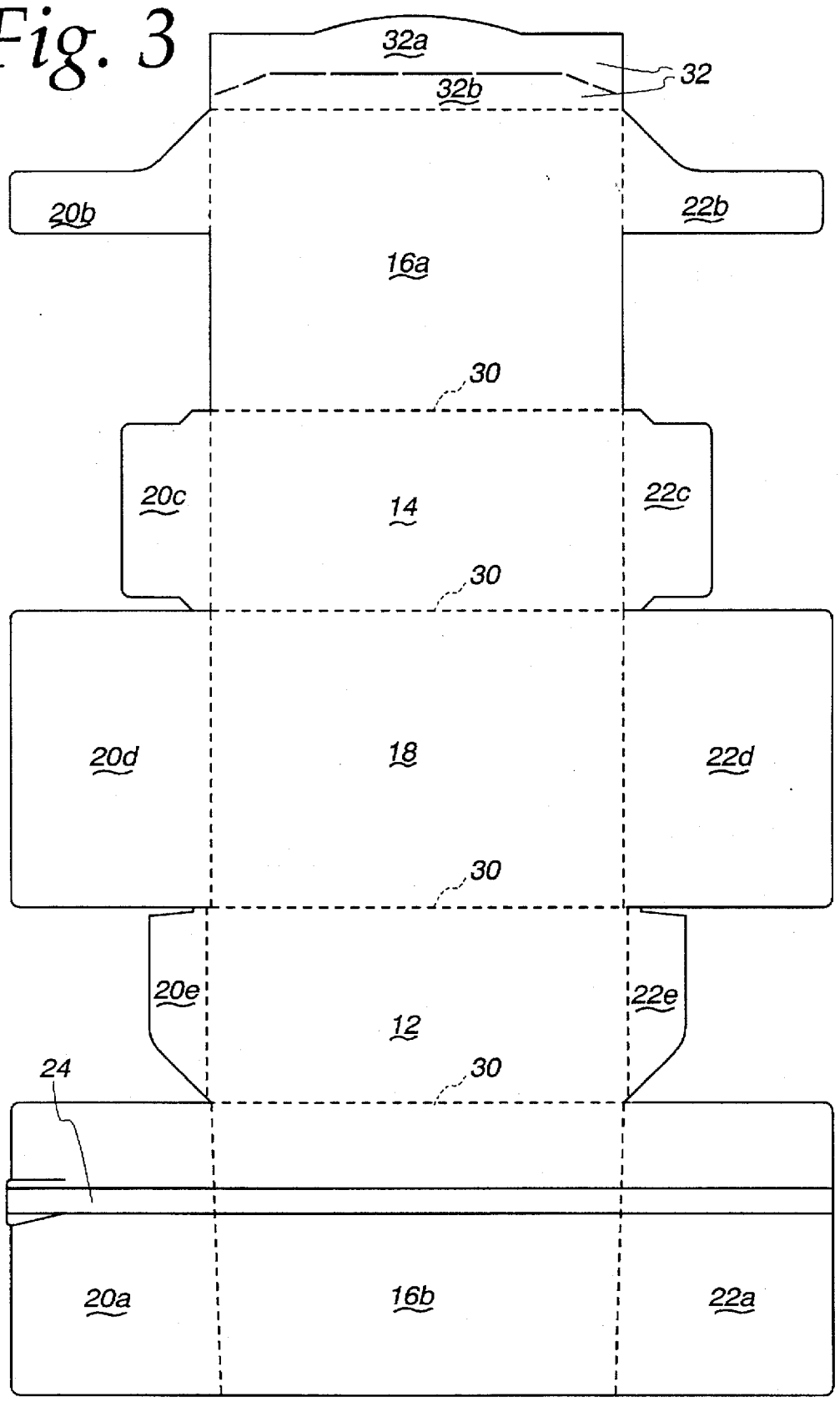
FIG. 3 is a plan view of the inside surface of a paperboard or corrugated cardboard blank used to form the carton in FIG. 1.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DESCRIPTION OF THE PREFERRED EMBODIMENTS

Turning now to the drawings, FIGS. 1 and 2 are perspective views of an exemplary side-filled, flip-top reclosable carton 10. FIG. 1 illustrates the carton 10 in closed form with a tear strip partially removed, and FIG. 2 illustrates the carton 10 in opened form following removal of the tear strip. The reclosable carton 10 in FIG. 1 is a six-sided parallelopiped enclosure formed of three pairs of opposing, generally rectangular walls. More specifically, the carton includes opposing top and bottom wails 12 and 14, opposing front and back walls 16 and 18, and opposing first and second side walls 20 and 22. As best shown in FIG. 2, the front wall 16 includes an inner panel **16*a* and an outer panel 16*b*. As described in detail below, various side closure flaps are hingedly connected to opposing ends of the top and bottom wails 12 and 14 and are hingedly connected to opposing ends of the front and back wails 16 and 18. These side closure flaps cooperate with each other to form the first and second side wails 20 and 22. The outermost flaps of the first and second side walls 20 and 22 are designated by the reference numerals 20*a* and 22*a***, respectively.

The outer front panel **16*b* and the outermost flaps 20*a* and 22*a* of the respective side walls 20 and 22 and, more specifically, the relative upper portions thereof, are provided with horizontal tear strip sections which effectively define an integral and continuous tear strip 24. The tear strip 24 effectively functions as means for convenient opening of the canon 10 once it has been filled with the requisite contents and sealed. Tearing or pulling away of the tear strip 24 as indicated in FIG. 1 effectively releases the sealed edges of the outermost side wall flaps 20*a* and 22*a* and the outer front panel 16*b* in order to delineate the carton 10 into a base section generally indicated as 26 in FIG. 2 and a lid generally indicated as 28 in FIG. 2. The arrangement is such that, once the tear strip 24 has been completely pulled away, the carton lid can be swung or raised upwardly away from the carton base section 26 by virtue of a hinged attachment of the horizontal edge of the top wall 12 to the corresponding horizontal edge of the back wall 18 of the carton 10**.

Referring now to FIG. 3, there is illustrated a plan view of the inside surface of a unitary, continuous paperboard or corrugated cardboard blank used for forming the carton 10 described above in connection with FIGS. 1 and 2. Identical reference numerals are used in the figures to indicate corresponding portions of the blank and the carton 10. The blank includes five vertically aligned, substantially rectangular panels **16*a*, 14, 18, 12, and 16*b* hingedly connected along horizontal score lines 30 which facilitate folding of the canon panels relative to each other. With respect to the manner in which these panels interact to define the closed carton shown in FIG. 1, the panel 16a functions as the front inner panel, the panel 14 functions as the bottom wall, the panel 18 functions as the back wall, the panel 12 functions as the top wall, and the panel 16b** functions as the front outer panel.

Each of the five main panels of the canon blank is provided with a pair of side closure flaps hingedly connected along respective opposing vertical ends by means of corresponding score lines. More specifically, first and second wing flaps 20b and 22b extend from opposing ends of the front inner panel 16a. First and second bottom minor flaps 20c and 22c extend from opposing ends of the bottom wall panel 14. First and second back major flaps 20d and 22d extend from opposing ends of the back wall panel 18. First and second top minor flaps 20e and 22e extend from opposing ends of the top wall panel 12. First and second front major flaps 20a and 22a extend from opposing ends of the front outer panel 16b. Any of the aforementioned flaps which are visible in FIGS. 1 and 2 are labelled with the appropriate reference numerals.

In the illustrative embodiment of FIG. 3, the first and second wing flaps 20b and 22b, the first and second back major flaps 20d and 22d, and the first and second front major flaps 20a and 22a have generally similar horizontal dimensions. However, the first and second bottom minor flaps 20c and 22c and the first and second top minor flaps 20e and 22e have horizontal dimensions which are substantially smaller than the horizontal dimensions of the other flaps.

The horizontal tear strip 24 extends integrally across the front outer panel 16b and its associated front major flaps 20a and 22a. The design and structure of the tear strip 24 and its operation in effective sealing and convenient tearing open of a carton of the type disclosed herein is fairly conventional and, accordingly, not described in detail herein. It suffices to state that the tear strip 24 is substantially in the form of a pair of guiding perforation-like (e.g., zipper perforation) or cut-scored parallel lines having a predefined depth of cut (at least about 30 percent) into the outer surfaces of the front outer panel 16b and its associated front major flaps 20a and 22a. The tear strip 24 optionally includes a reinforcing tape attached to its inner surface to prevent the strip from breaking apart as a result of the strip being removed from the carton 10 during the unsealing operation.

The blank in FIG. 3 optionally includes an extension flap 32 hingedly connected to the upper horizontal edge of the front inner panel 16a along a horizontal score line 34. The extension flap 32 includes a distal island portion 32a and a proximal hinged portion 32b which are linked together by means of weakening "nicks", whereby the distal island portion 32a may easily be separated from the proximal hinged portion 32b. In the carton 10 depicted in FIGS. 1 and 2, the distal island portion 32a is adhered to the inner surface of the front outer panel 16b above the tear strip 24. When the tear strip 24 is removed and the lid 28 is rotated away from the base section 26 as shown in FIG. 2, the distal island portion 32a separates from the proximal hinged portion 32b by breaking free of its restricting nicks and remains attached to the inner surface of the front outer panel 16b. Reclosure and positive locking of the lid 28 to the base section 26 in FIG. 2 is accomplished by pushing the lid 28 back down to its original position and by snap engagement of the distal island portion 32a and the proximal hinged portion 32b. Additional information concerning the foregoing type of positive locking arrangement may be obtained from U.S. Pat. Nos. 5,161,734; 5,154,343; 5,265,799; and 5,314,114, which are each fully incorporated herein by reference.

Figure 4:
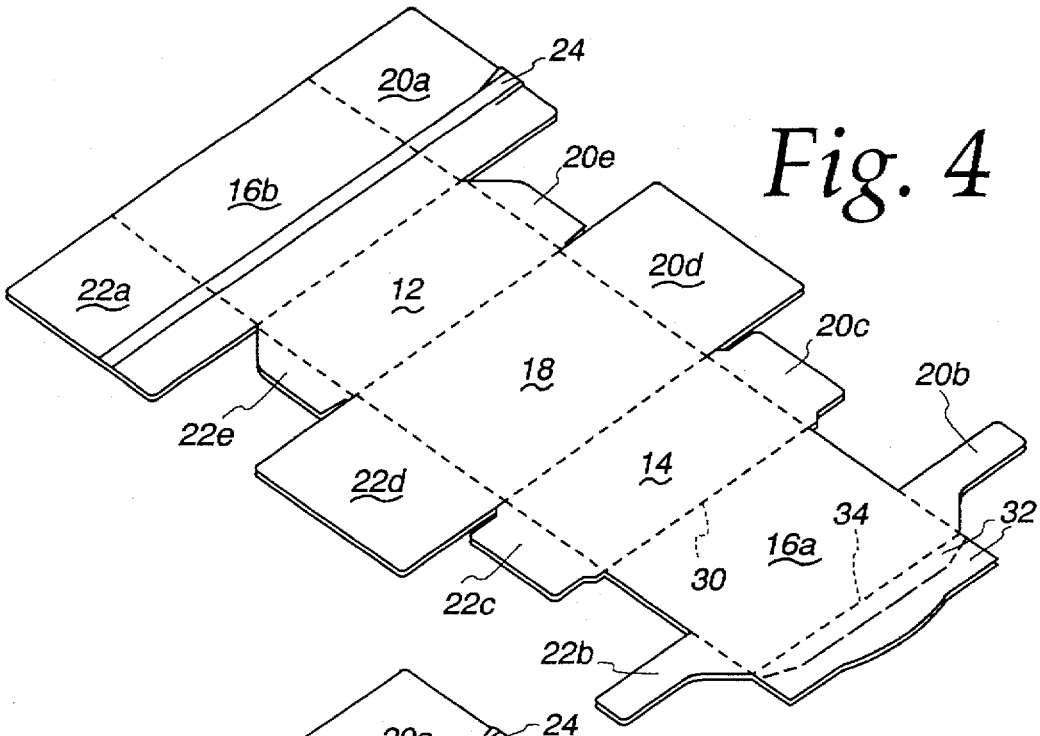
FIG. 4 is a perspective view of the blank used to form the carton in FIG. 1.
Figure 5:
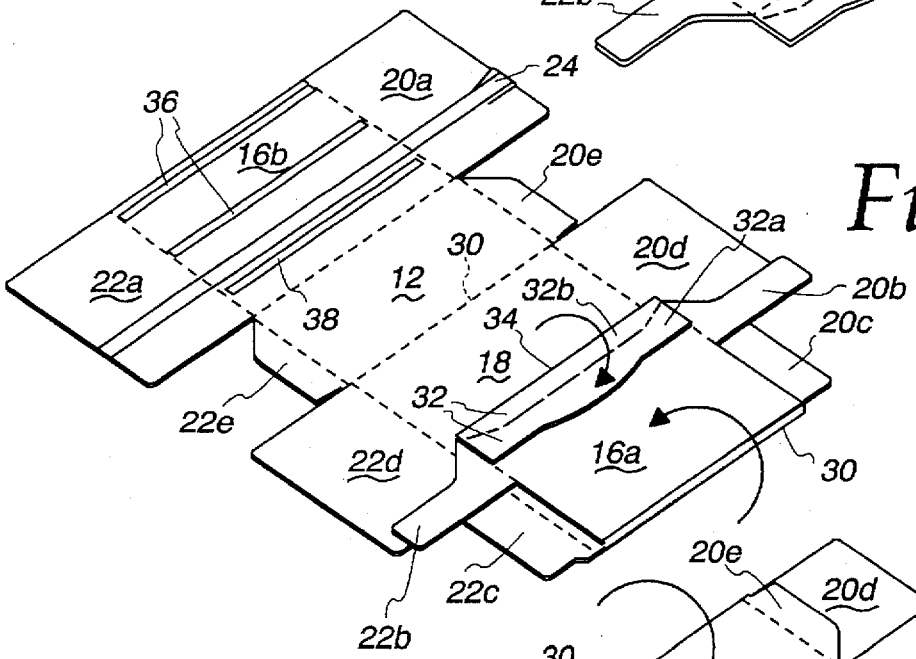
FIG. 5 is a perspective view of the blank in partially folded form.

In an alternative embodiment, the carton 10 does not employ the extension flap 32, but rather locking of the lid 28 to the base section 26 is realized by a friction fit between the lid 28 and an upper marginal portions of the front inner panel 16a, the first back major flap 20d, and the second back major flap 22d. FIGS. 4–14 illustrate the manner in which the carton 10 is formed from the unitary, continuous blank. FIG. 4 is a perspective view of the blank in unfolded form, and FIG. 5 is a perspective view of the blank is partially folded form. To realize the partially folded blank in FIG. 5, the front inner panel 16a is rotated 180 degrees relative to the bottom wall panel 14 about the score line 30 so that the inner surface of the front inner panel 16a is adjacent to the inner surface of the bottom wall panel 14. Also, the extension flap 32 is rotated 180 degrees relative to the front inner panel 16a about the score line 34 so that the outer surface of the extension flap 32 is adjacent to the outer surface of the front inner panel 16a (FIG. 5).

Figure 6:
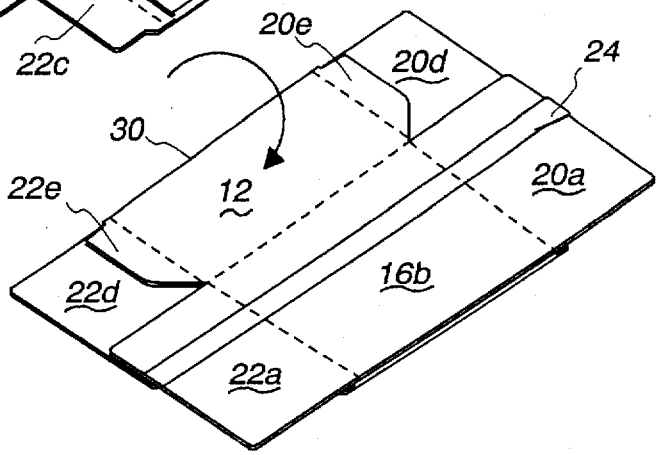
FIG. 6 is a perspective view of the carton in flattened (unerected) tubular form.

FIG. 6 is a perspective view of the carton 10 in flattened (unerected) tubular form. The flattened carton 10 in FIG. 6 is realized by first applying strips of adhesive 36 to the inner surface of the front outer panel 16b beneath the tear strip 24. Alternatively, the adhesive may be applied to the outer surface of the front inner panel 16a. A strip of adhesive 38 is also applied to the inner surface of the front outer panel 16b just above the tear strip 24. Alternatively, this adhesive may be applied to the inner surface of the island portion 32a. Next, the top wall panel 12 is rotated 180 degrees relative to the back wall panel 18 about the score line 30 so that the inner surface of the top wall panel 12 is adjacent to the inner surface of the back wall panel 18. The strips of adhesive 36 bond the inner surface of the front outer panel 16b to the outer surface of the front inner panel 16a. The strip of adhesive 38 is properly positioned to bond the inner surface of the distal island portion 32a to the inner surface of the front outer panel. The proximal hinged portion 32b remains free of adhesive.

Figure 7:
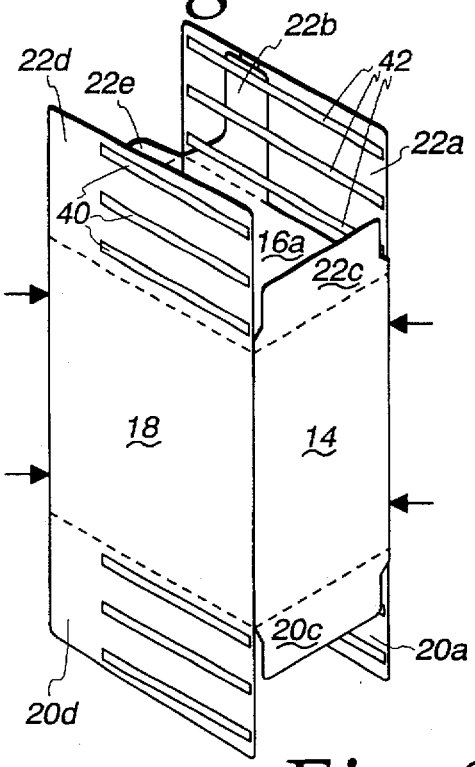
FIG. 7 is a perspective view of the carton in the form of an erected, open-sided rectangular sleeve.

FIG. 7 is a perspective view of the carton 10 in the form of an erected, opensided rectangular sleeve. To realize the rectangular sleeve from the unerected carton in FIG. 6, pressure is applied to opposing sides of the flattened carton 10 as depicted by the arrows in FIG. 7. Next, one of the open sides of the carton 10 is sealed using a conventional flap folding sequence, in conjunction with strategically applied adhesive, to create a sealed side wall. FIGS. 7–10 show the flap folding sequence and adhesive application with respect to the flaps 22a, 22b, 22c, 22d, and 22e, which are used to form the side wall 22 of the carton 10. The flaps are configured so that the strategic application of adhesive allows the flaps to be folded to form the side wall 22 using a conventional flap folding sequence.

Figure 9:
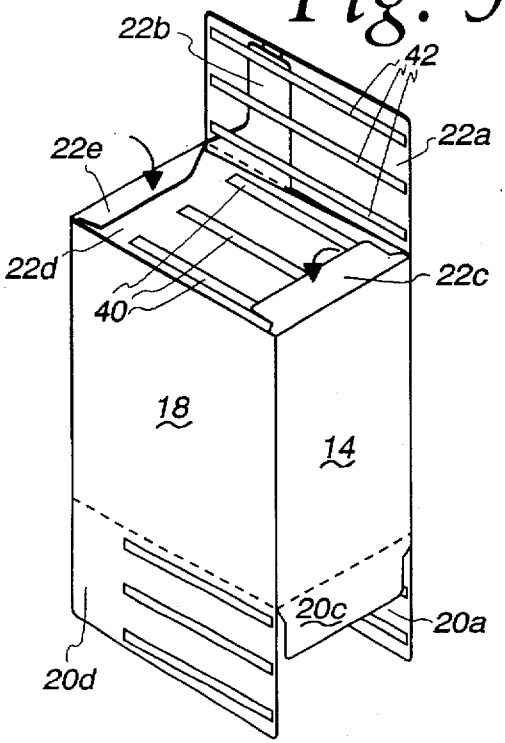

In FIG. 7 adhesive 40 is applied to a substantial portion of the outer surface of the second back major flap 22d, except for a narrow left portion (as viewed in FIG. 7) which remains free of the adhesive. Adhesive is not applied to this narrow left portion so that the second top minor flap 22e does not adhere to the second back major flap 22d when folded over as shown in FIG. 9. Therefore, the narrow left portion of the second back major flap 22d which remains free of adhesive should be sufficiently large to accommodate the folded second back major flap 22d without adhering thereto.

In addition to the adhesive 40, adhesive 42 is applied to the inner surfaces of the second front major flap 22a and the second wing flap 22b. As the second wing flap 22b overlaps the second front major flap 22a when the adhesive 42 is applied, the shielded portion of the second front major flap 22*a* beneath and abutting the second wing flap 22*b* is free of the adhesive. Therefore, the second wing flap 22*b* is not adhered to the second front major flap 22*a*. Since the tear strip 24 on the second front major flap 22*a* is immediately adjacent to the second wing flap 22*b*, it is desirable to keep the second wing flap 22*b* unattached to the second front major flap 22*a* to facilitate removal of the tear strip 24 and to permit subsequent opening of the lid 28.

Figure 8:
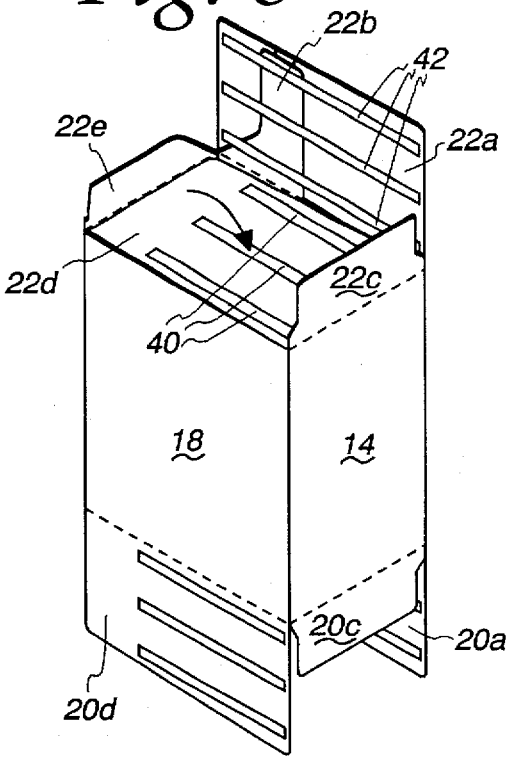
FIGS. 8, 9, and 10 are perspective views of the erected carton showing the flap folding sequence for sealing a first open side of the open-sided rectangular sleeve in FIG. 7.

Following the application of the adhesive 40 and 42 as described above, the flaps 22*a*, 22*b*, 22*c*, 22*d*, and 22*e* are folded using a conventional flap folding sequence implemented with conventional form-fill-seal equipment. In particular, the second back major flap 22*d* is rotated inward approximately 90 degrees relative to the back wall panel 18 (FIG. 8). Next, the second top and bottom minor flaps 22*e* and 22*c* are rotated inward approximately 90 degrees relative to the respective top and bottom wall panels 12 and 14 (FIG. 9). The adhesive 40 adheres the inner surface of the second bottom minor flap 22*c* to the outer surface of the second back major flap 22*d*. However, as described above, the second top minor flap 22*e* remains unattached to the second back major flap 22*d* due to the lack of adhesive therebetween.

Figure 10:
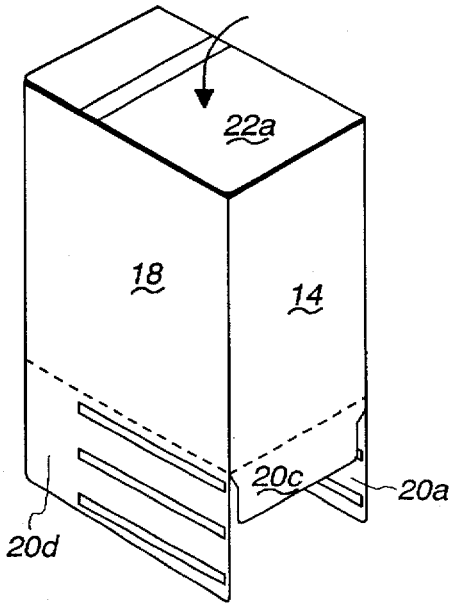

The final step in the flap folding sequence is to rotate the second front major flap 22*a* and the overlapping second wing flap 22*b* inward approximately 90 degrees relative to the respective front outer panel 16*b* and front inner panel 16*a* (FIG. 10). As the second wing flap 22*b* is disposed inwardly adjacent to the second front major flap 22*a*, folding the second front major flap 22*a* causes the second wing flap 22*b* to fold in tandem therewith. The adhesive 42 adheres the inner surface of the second front major flap 22*a* to the outer surfaces of the second top minor flap 22*e*, the second bottom minor flap 22*c*, and the second back major flap 22*d*. The adhesive 42 also adheres the inner surface of the second wing flap 22*b* to the outer surface of the second back major flap 22*d*. The second wing flap 22*b* is specially profiled so that when the second wing flap 22*b* is folded inward and attached to the second back major flap 22*d*, the second wing flap 22*b* does not overlap the second top minor flap 22*e*. Rather, the second wing flap 22*b* is substantially co-planar with and immediately adjacent to the second top minor flap 22*e*. The curvilinear edge profile of second wing flap 22*b* substantially matches the curvilinear edge profile of the second top minor flap 22*e* so that the profiled edge of the second wing flap 22*b* practically or actually abuts the profiled edge of the second top minor flap 22*e*.

Figure 11:
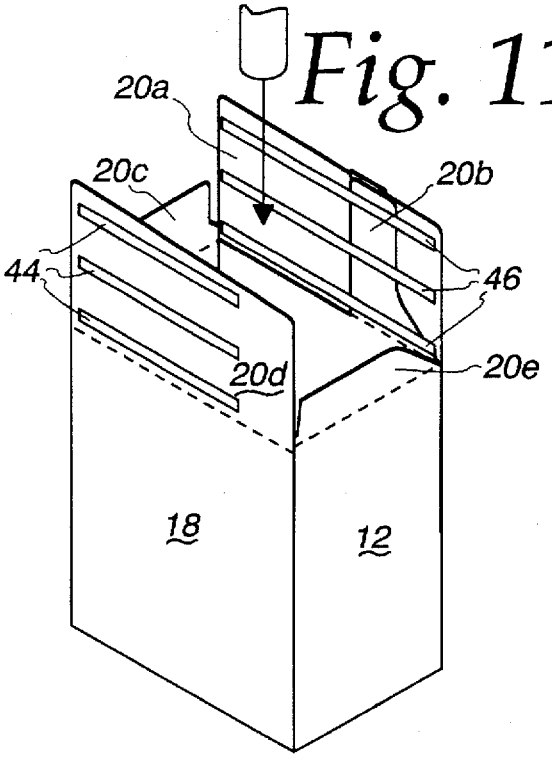
FIG. 11 is a perspective view of the erected carton showing the carton being filled through a second open side of the open-sided rectangular sleeve in FIG. 7.

After sealing the second side wall 22 of the carton 10 as illustrated in FIG. 10, a product such as granular detergent is loaded into the carton 10 via the open side thereof. In FIG. 11 this open side is the unsealed first side wall 20. The arrow in FIG. 11 indicates the loading of the product into the carton via this unsealed first side wall 20.

After the carton 10 is filled with the product, the first side wall 20 is sealed in a similar manner used to seal the side wall 22. The sealing process employs a conventional flap folding sequence, in conjunction with strategically applied adhesive. FIGS. 11–14 show the flap folding sequence and adhesive application with respect to the flaps 20*a*, 20*b*, 20*c*, 20*d*, and 20*e*, which are used to form the side wall 20 of the carton 10. The flaps are configured so that the strategic application of adhesive allows the flaps to be folded to form the side wall 20 using a conventional flap folding sequence.

Figure 13:
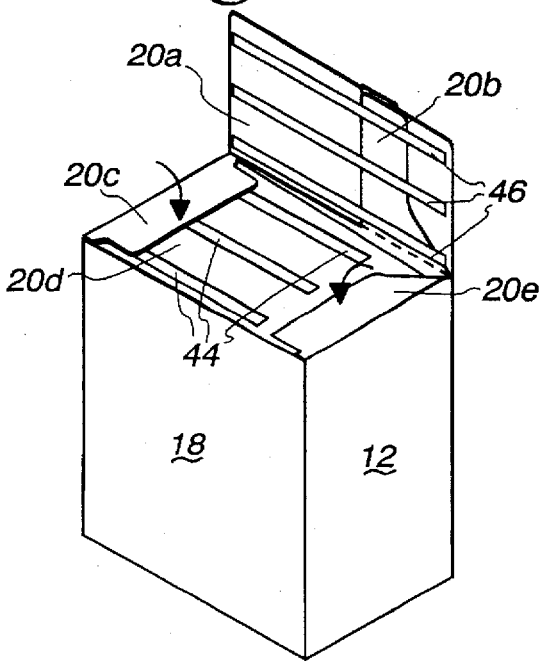

In FIG. 11 adhesive 44 is applied to a substantial portion of the outer surface of the first back major flap 20*d*, except for a narrow fight portion (as viewed in FIG. 11) which remains free of the adhesive. Adhesive is not applied to this narrow fight portion so that the first top minor flap 20*e* does not adhere to the first back major flap 20*d* when folded over as shown in FIG. 13. Therefore, the narrow right portion of the first back major flap 20*d* which remains free of adhesive should be sufficiently large to accommodate, the folded first back major flap 20*d* without adhering thereto.

In addition to the adhesive 44, adhesive 46 is applied to the inner surfaces of the first front major flap 20*a* and the first wing flap 20*b*. As the first wing flap 20*b* overlaps the first front major flap 20*a* when the adhesive 46 is applied, the shielded portion of the first front major flap 20*a* beneath and abutting the first wing flap 20*b* is free of the adhesive. Therefore, the first wing flap 20*b* is not adhered to the first front major flap 20*a*. Since the tear strip 24 on the first front major flap 20*a* is immediately adjacent to the first wing flap 20*b*, it is desirable to keep the first wing flap 20*b* unattached to the first front major flap 20*a* to facilitate removal of the tear strip 24 and to permit subsequent opening of the lid 28.

Figure 12:
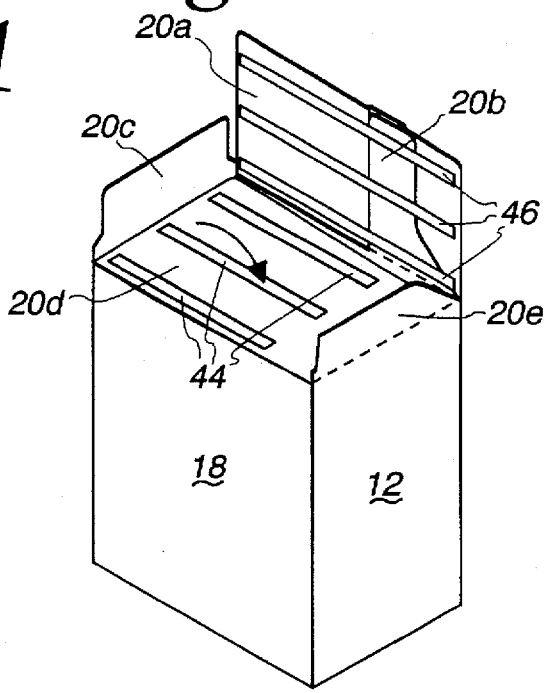
FIGS. 12, 13, and 14 are perspective views of the erected carton showing the flap folding sequence for sealing the second open side of the open-sided rectangular sleeve in FIG. 7.

Following the application of the adhesive 44 and 46 as described above, the flaps 20*a*, 20*b*, 20*c*, 20*d*, and 20*e* are folded using a conventional flap folding sequence implemented with conventional form-fill-seal equipment. In particular, the first back major flap 20*d* is rotated inward approximately 90 degrees relative to the back wall panel 18 (FIG. 12). Next, the first top and bottom minor flaps 20*e* and 20*c* are rotated inward approximately 90 degrees relative to the respective top and bottom wall panels 12 and 14 (FIG. 13). The adhesive 44 adheres the inner surface of the first bottom minor flap 20*c* to the outer surface of the first back major flap 20*d*. However, as described above, the first top minor flap 20*e* remains unattached to the first back major flap 20*d* due to the lack of adhesive therebetween.

Figure 14:
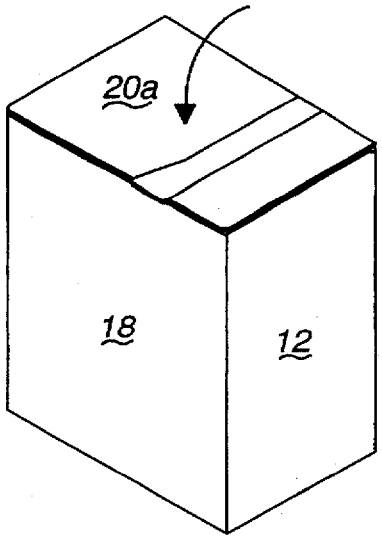

The final step in the flap folding sequence is to rotate the first front major flap 20*a* and the overlapping first wing flap 20*b* inward approximately 90 degrees relative to the respective front outer panel 16*b* and front inner panel 16*a* (FIG. 14). As the first wing flap 20*b* is disposed inwardly adjacent to the first front major flap 20*a*, folding the first front major flap 20*a* causes the first wing flap 20*b* to fold in tandem therewith. The adhesive 46 adheres the inner surface of the first front major flap 20*a* to the outer surfaces of the first top minor flap 20*e*, the first bottom minor flap 20*e*, and the first back major flap 20*d*. The adhesive 46 also adheres the inner surface of the first wing flap 20*b* to the outer surface of the first back major flap 20*d*. The first wing flap 20*b* is specially profiled so that when the first wing flap 20*b* is folded inward and attached to the first back major flap 20*d*, the first wing flap 20*b* does not overlap the first top minor flap 20*e*. Rather, the first wing flap 20*b* is substantially co-planar with and immediately adjacent to the first top minor flap 20*e*. The curvilinear edge profile of first wing flap 20*b* substantially matches the curvilinear edge profile of the first top minor flap 20*e* so that the profiled edge of the first wing flap 20*b* practically or actually abuts the profiled edge of the first top minor flap 20*e*.

Sealing the first side wall 20 as described above produces the fully sealed carton 10 depicted in FIG. 14. To open the flip-top reclosable carton 10, the tear strip 24 is removed (FIG. 1) and the lid 28 is raised upwardly from the base 26 (FIG. 2). To reclose the carton 10, the lid 28 is returned to its original closed position. The lid 28 is maintained in this closed position either by snap engagement of the distal island portion 32*a* and the proximal hinged portion 32*b* or by frictional engagement of the lid 28 and upper marginal portions of the base 26.

In an alternative embodiment, the front outer panel 16*b* and the first and second front major flaps 20*a* and 22*a* are modified so that they terminate short of the bottom wall 14. Such a partial front outer panel and partial front major flaps may, for example, extend from the top wail 12 to just below the tear strip 24. To compensate for the shortened front major flaps, the first and second wing flaps 20*b* and 22*b* are increased in length so that they substantially extend to the bottom wail 14. The portion of the partial front outer panel below the tear strip 24 is attached to the front inner panel 16*a*. Likewise, the portions of the first and second front major flaps just below the tear strip 24 are attached to the lengthened first and second wing flaps, respectively. Providing the partial front outer panel and the partial front major flaps reduces the amount of paperboard used to manufacture the carton 10, and this paperboard savings reduces the cost of manufacturing the carton 10.

In accordance with the present invention, FIGS. 15–20 each depict a pair of identical blanks which differ from the blank depicted in FIG. 3. The blank in each of FIGS. 15–20 differs from the blank in FIG. 3 in that the blank in each of FIGS. 15–20 can be nested with an identical adjacent blank as depicted in the figures. The nested blanks occupy a smaller surface area during the blank manufacturing process. Each of the blanks in FIGS. 15–20 is symmetrical about a vertical axis of symmetry which is denoted in each figure by the designation "CL". The vertical axis of symmetry "CL" passes through a vertical center line of each panel. Since each blank is symmetrical, nesting is described and illustrated with reference to the set of side closure flaps located to one side of the vertical axis of symmetry "CL". In connection with FIG. 15, for example, nesting is only described and illustrated with reference to the first side closure flaps 120*a–e*. It should be understood, however, that identical nesting can occur on the other side of the vertical axis of symmetry by forming a blank adjacent to the side closure flaps on that other side of the vertical axis of symmetry.

To facilitate an understanding of the functions of the panels and flaps in FIGS. 15–20, panels and flaps in FIGS. 15–20 are designated by reference numerals which vary by a multiple of 100 from the reference numerals associated with analogous panels and flaps of the blank in FIG. 3. Scrap or "dead" areas between the nested blanks in each figure are designated by X's. These dead areas generate scrap material which is either discarded or, more preferably, recycled.

Figure 15:
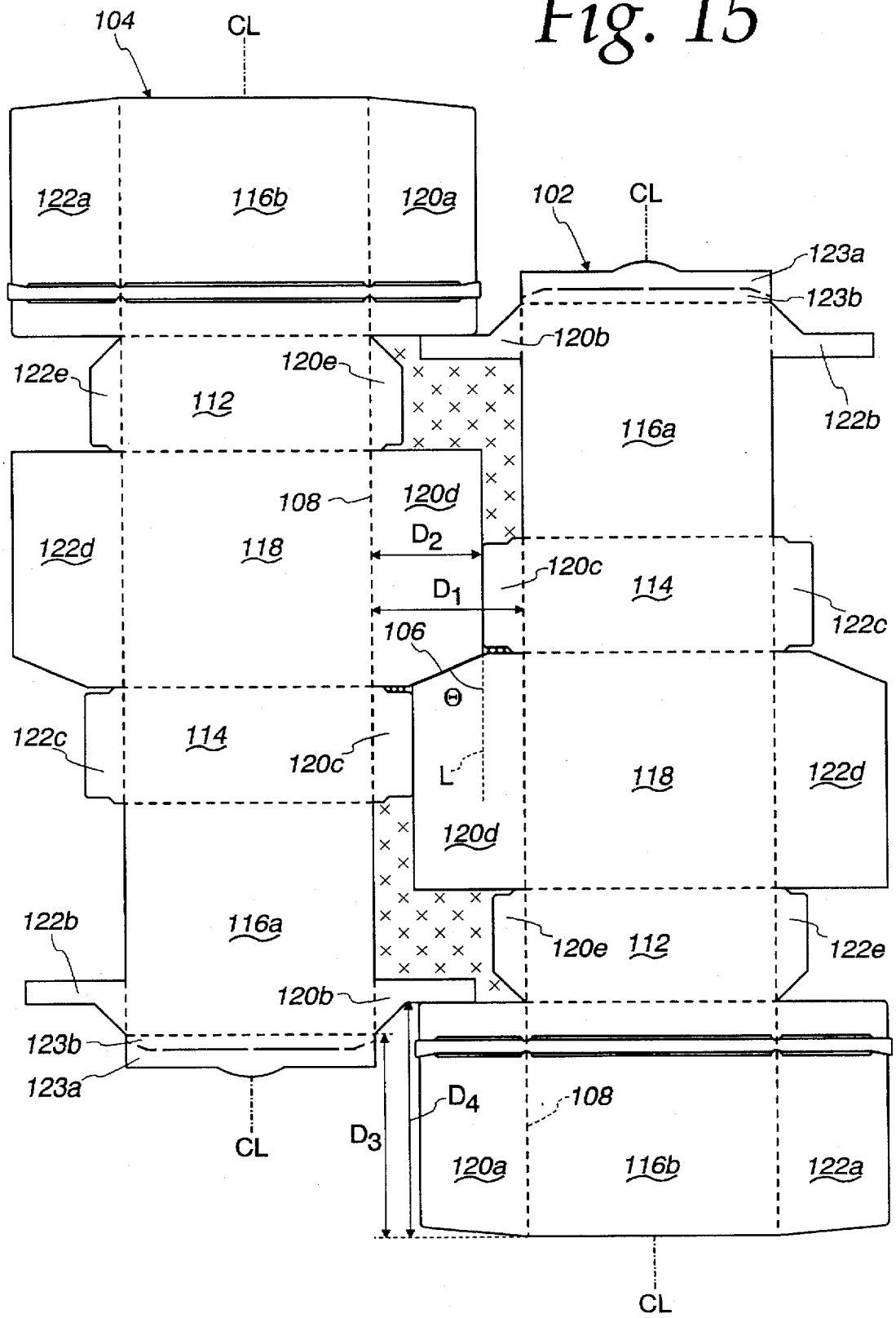
FIG. 15 is a plan view of the inside surface of a pair of nested blanks embodying the present invention.

Referring to FIG. 15, there is shown a pair of identical nested blanks 102 and 104. To permit nesting of the blanks 102 and 104, the blank 102 is vertically oriented in a first direction while the blank 104 is vertically oriented in a second direction opposite to the first direction. Each of the blanks 102 and 104 includes first side closure flaps 120*a–e* and second side closure flaps 122*a–e*. The side closure flaps 120*a*, 120*b*, and 120*d* of the blank 102 are nested with the side closure flaps 120*a*, 120*b*, and 120*d* of the blank 104. As explained above, since the blanks 102 and 104 are symmetrical about respective vertical axes of symmetry "CL", the blank 104 could be positioned to the right of the blank 102 so that the side closure flaps 122*a*, 122*b*, and 122*d* of the blank 102 are nested with the side closure flaps 122*a*, 122*b*, and 122*d* of the blank 104.

Specifically, an upper horizontal edge of the partial-height inner front major flap 120*b* (i.e. wing flap) of the blank 102 abuts a lower horizontal edge of the full-height outer front major flap 120*a* of the oppositely-directed blank 104. The left vertical edge of the bottom minor flap 120*c* of the blank 102 abuts a fight vertical edge of the back major flap 120*d* of the blank 104. An angled upper edge 106 of the back major flap 120*d* of the blank 102 abuts an angled lower edge 106 of the back major flap 120*d* of the blank 104. The left vertical edge of the back major flap 120*d* of the blank 102 abuts the right vertical edge of the bottom minor flap 120*c* of the blank 104. The upper horizontal edge of the outer front major flap 120*a* of the blank 102 abuts the lower horizontal edge of the inner front major flap 120*b* of the blank 104.

The side closure flaps 120*a–e* of each blank are hingedly connected to the panels thereof along vertical score lines 108. When the blanks 102 and 104 are nested, a horizontal distance $D_1$ between the vertical lines 108 of the blank 102 and the vertical score lines 108 of the blank 104 is necessarily less than twice a horizontal dimension $D_2$ of the side closure flap or flaps having the largest horizontal dimension at some horizontal line along the flap or flaps. In this case, the side closure flaps having the largest horizontal dimension are the inner front major flap 120*b*, the back major flap 120*d*, and the outer front major flap 120*a*. These three side closure flaps have substantially the same horizontal dimension $D_2$. An advantageous feature of each blank in FIG. 15 is the angled edge 106 of the back major flap 120*d*. It is this angled edge 106 which reduces the surface area of each blank and, at the same time, permits the blanks 102 and 104 to be nested without having the flat surfaces of the blanks 102 and 104 overlap each other. In the illustrated embodiment, the angled edge 106 forms an angle θ of approximately 65 to 70 degrees relative to the vertical line L, which is parallel to the vertical score lines 108. This angle θ of course can vary greatly depending on the amount of vertical offset between the back major flap 120*d* of the blank 102 and the back major flap 120*d* of the blank 104.

Without regard to the optional locking flaps 132*a* and 132*b*, the blanks 102 and 104 in FIG. 15 are vertically offset (staggered) relative to each other by a vertical distance $D_3$. This vertical distance $D_3$ is preferably less than a vertical dimension $D_4$ of the side closure flap or flaps having the largest vertical dimension. In this case, the side closure flaps having the largest vertical dimension are the back major flap 120*d* and the outer front major flap 120*a*. These two side closure flaps have approximately the same vertical dimension $D_4$. The aforementioned limitation on the vertical offset of the blanks 102 and 104 insures that the blanks 102 and 104 are condensed into a smaller rectangular area which can be accommodated by a die-cutting machine. The area to the left of the outer front major flap 120*a* of the blank 102 and beneath the island portion 132*a* of the blank 104 is wasted or "dead" area which is preferably kept to a minimum.

During a typical blank manufacturing process, a web of paperboard or corrugated board is fed through a die-cutting machine which simultaneously die-cuts that web into a plurality of blanks. Although FIG. 15 only illustrates a pair of nested blanks 102 and 104 which are simultaneously die-cut by a die-cutting machine, additional blanks can be nested with and simultaneously die-cut with the blanks 102 and 104. For example, the side closure flaps 122*a–e* of the blank 102 may be nested with side closure flaps of an oppositely-directed identical blank formed to the right of the blank 102 as viewed in FIG. 15. Since nesting the blanks 102 and 104 reduces the surface area occupied by the blanks 102 and 104, the die-cutting machine might be able to simultaneously form more blanks than if the blanks were not nested with each other. If, for example, the die-cutting machine can only form four blanks at the same time in the absence of nesting, nesting might permit a fifth blank to be formed at the same time as the other four blanks. This, in turn, increases the throughput of the die-cutting machine.

Each blank in FIG. 15 may be folded and glued to form a carton similar to the carton 10 in FIGS. 1 and 2. Using a conventional folding sequence, the blank is folded and glued in the manner disclosed above in connection with FIGS. 5–14. Accordingly, the process of forming the blank into the carton is not repeated herein. To achieve nesting of blanks in FIG. 15, the inner front major flap 120*b*, the back major flap 120*d*, and the outer front major flap 120*a* have a full width in the horizontal dimension. As is well known, full-width flaps extend substantially across the width of the side wall of the formed carton. With reference to the exemplary carton 10 in FIG. 1, the width dimension of the side wall 20 may be defined as the horizontal direction taken parallel to the top and bottom walls 12 and 14. It is further noted that the front outer panel 116*b* and its outer front major flaps 120*a* and 122*a* have a full height in the vertical dimension. With reference once again to the exemplary carton 10 in FIG. 1, the height dimension of the front outer panel 16*b* may be defined as the vertical direction taken parallel to the side walls 20 and 22.

Figure 16:
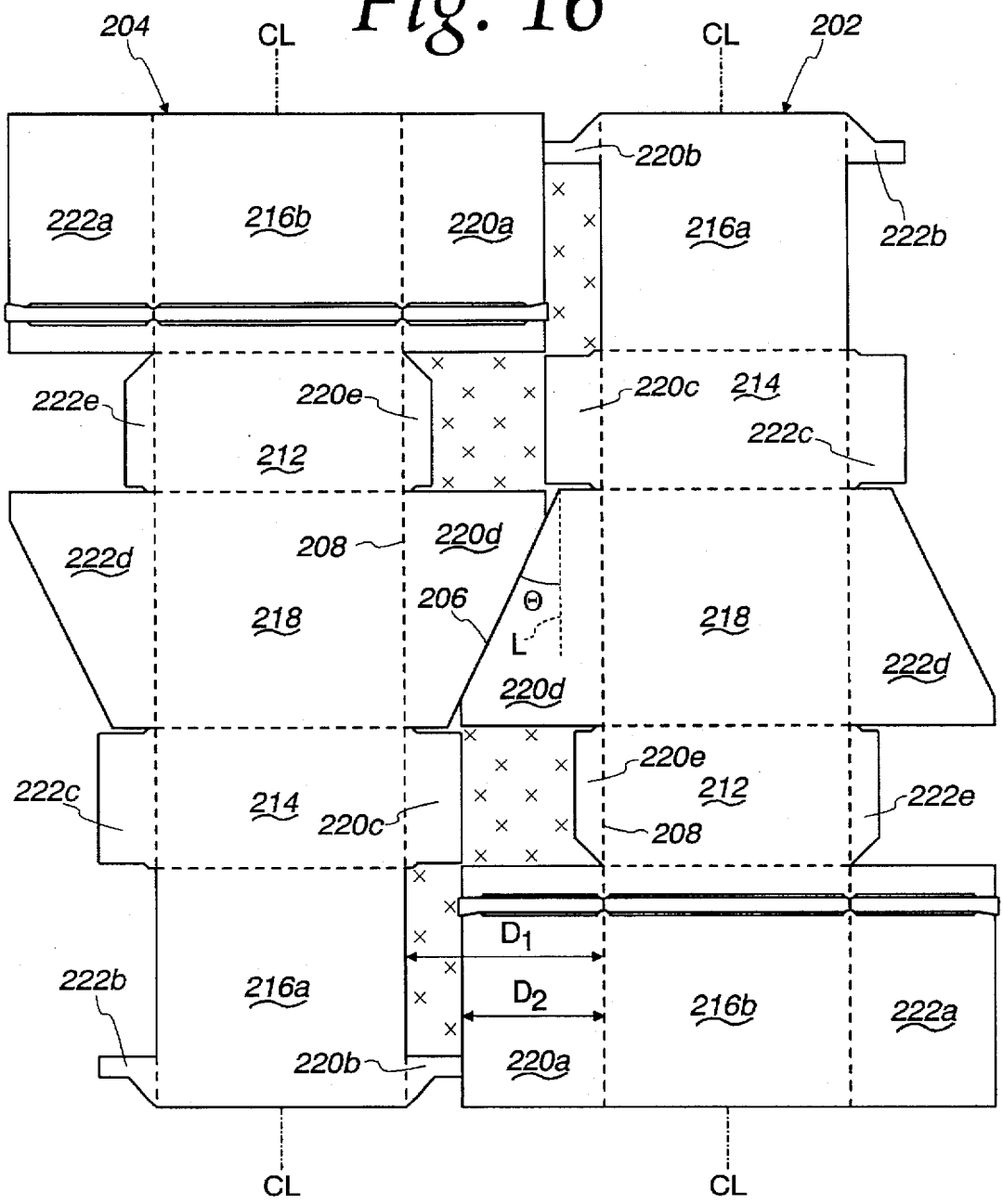
FIG. 16 is a plan view of the inside surface of a modified pair of nested blanks embodying the present invention.

FIG. 16 depicts a modified pair of identical nested blanks 202 and 204. To permit nesting of the blanks 202 and 204, the blank 202 is vertically oriented in a first direction while the blank 204 is vertically oriented in a second direction opposite to the first direction. Each of the blanks 202 and 204 includes first side closure flaps 220*a–e* and second side closure flaps 222*a–e*. The side closure flaps 220*a* and 220*d* of the blank 202 are nested with the side closure flaps 220*a* and 220*d* of the blank 204.

Specifically, a left vertical edge of the partial-height inner front major flap 220*b* of the blank 202 abuts a right vertical edge of the full-height outer front major flap 220*a* of the blank 204. An angled left edge 206 of the back major flap 220*d* of the blank 202 abuts an angled right edge 206 of the back major flap 220*d* of the blank 204. A left vertical edge of the outer front major flap 220*a* of the blank 202 abuts a right vertical edge of the inner front major flap 220*b* of the blank 204.

The side closure flaps 220*a–e* of each blank are hingedly connected to the panels thereof along vertical score lines 208. When the blanks 202 and 204 are nested, a horizontal distance $D_1$ between the vertical lines 208 of the blank 202 and the vertical score lines 208 of the blank 204 is necessarily less than twice a horizontal dimension $D_2$ of the side closure flap or flaps having the largest horizontal dimension. In this case, the side closure flaps having the largest horizontal dimension are the back major flap 220*d* and the outer front major flap 220*a*. These two side closure flaps have substantially the same horizontal dimension $D_2$. An advantageous feature of each blank in FIG. 16 is the angled edge 206 of the back major flap 220*d*. This angled edge 206, in conjunction with shortening the horizontal dimension of the inner front major flap 220*b*, reduces the surface area of each blank and, at the same time, permits the blanks 202 and 204 to be nested without having the flat surfaces of the blanks 202 and 204 overlap each other. The inner front major flap 220*b* must be shortened in its horizontal dimension so that the flaps 220*b* and 220*a* of the blank 202 do not overlap the respective flaps 220*a* and 220*b* of the blank 204. In the illustrated embodiment, the angled edge 206 forms an angle θ of approximately 25 to 30 degrees relative to the vertical line L. This angle θ can vary greatly depending on the amount of vertical offset between the flaps 220*d* of the respective blanks 202 and 204.

Unlike the nested blanks 102 and 104 illustrated in FIG. 15, the blanks 202 and 204 in FIG. 16 are not vertically offset (staggered) relative to each other. Rather, the blanks 202 and 204 are aligned such that horizontal score lines connecting the panels of the blank 202 are in line with corresponding horizontal score lines connecting the panels of the blank 204.

Using the conventional folding sequence and adhesive application disclosed in connection with FIGS. 5–14, each blank in FIG. 16 may be folded and glued to form a carton similar to the cannon 10 in FIGS. 1 and 2. Like the blanks in FIG. 15, it is noted that the front outer panel 216*b* and its flaps 220*a* and 222*a* in FIG. 16 have a full height in the vertical dimension.

Figure 17:
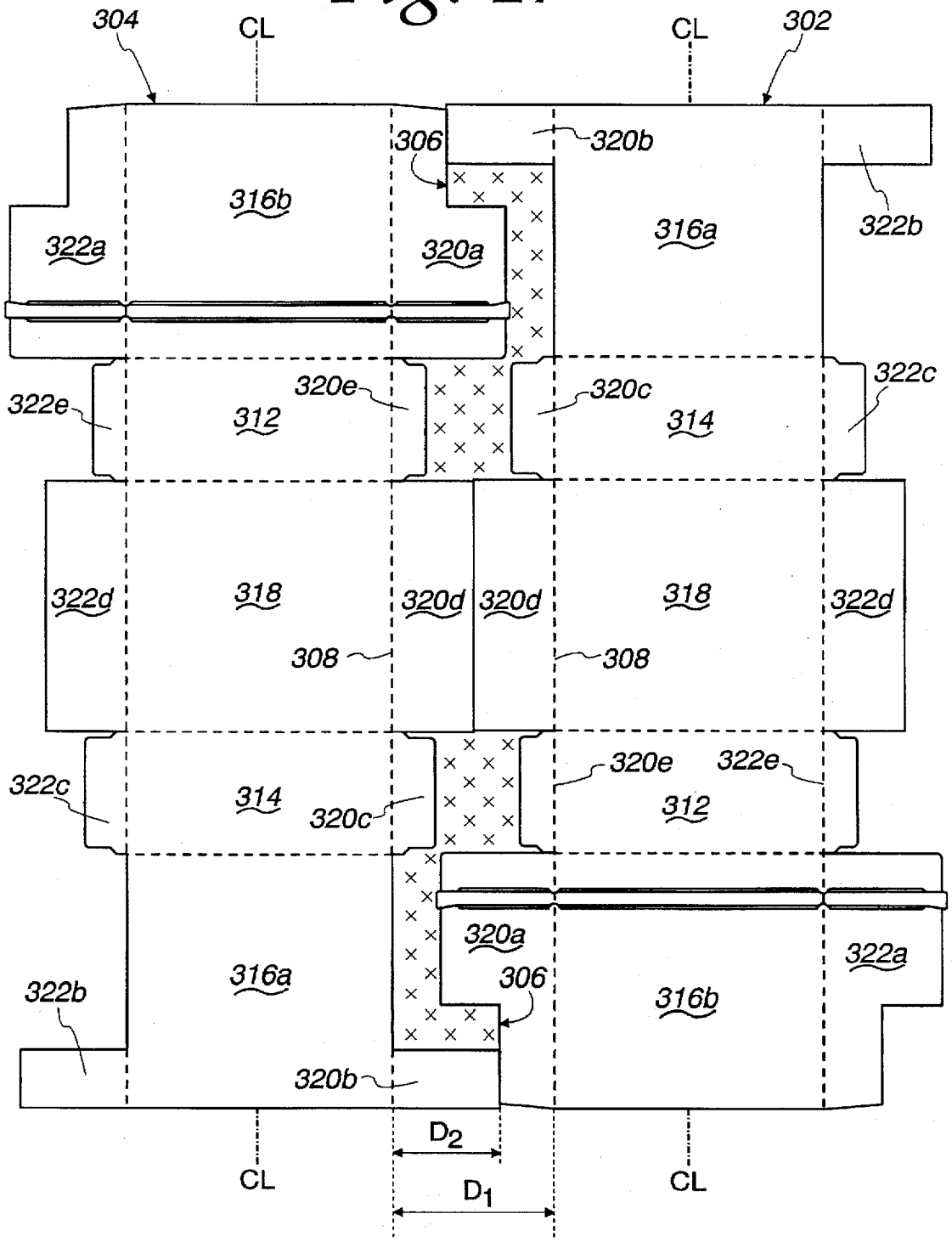
FIG. 17 is a plan view of the inside surface of a modified pair of nested blanks embodying the present invention.

FIG. 17 depicts another modified pair of identical nested blanks 302 and 304. To permit nesting of the blanks 302 and 304, the blank 302 is vertically oriented in a first direction while the blank 304 is vertically oriented in a second direction opposite to the first direction. Each of the blanks 302 and 304 includes first side closure flaps 320*a–e* and second side closure flaps 322*a–e*. The side closure flaps 320*a*, 320*d*, and 320*b* of the blank 302 are nested with the side closure flaps 320*a*, 320*d*, and 320*b* of the blank 304.

Specifically, a left vertical edge of the partial-height inner front major flap 320*b* of the blank 302 abuts an upper right vertical edge of the full-height outer front major flap 320*a* of the blank 304. A left vertical edge of the partial-width back major flap 320*d* of the blank 302 abuts a right vertical edge of the partial-width back major flap 320*d* of the blank 304. A lower left vertical edge of the outer front major flap 320*a* of the blank 302 abuts a right vertical edge of the inner front major flap 320*b* of the blank 304.

The side closure flaps 320*a–e* of each blank are hingedly connected to the panels thereof along vertical score lines 308. When the blanks 302 and 304 are nested, a horizontal distance $D_1$ between the vertical lines 308 of the blank 302 and the vertical score lines 308 of the blank 304 is necessarily less than twice a horizontal dimension $D_2$ of the side closure flap or flaps having the largest horizontal dimension. In this case, the side closure flaps having the largest horizontal dimension are the inner front major flap 320*b* and the outer front major flap 320*a*. These two side closure flaps have the same horizontal dimension $D_2$. An advantageous feature of each blank in FIG. 17 is the cutout section 306 of the outer front major flap 320*a*. This cutout section 306 allows the outer front major flap 320*a* to accommodate the inner front major flap 320*b*. Nesting the inner and outer front major flaps 320*b* and 320*a* requires shortening of the back major flap 320*d* so that the back major flap 320*d* of the blank 302 does not overlap the back major flap 320*d* of the blank 304.

Like the nested blanks 202 and 204 illustrated in FIG. 16, the blanks 302 and 304 in FIG. 17 are not vertically offset (staggered) relative to each other. The blanks 302 and 304 are aligned such that horizontal score lines connecting the panels of the blank 302 are in line with corresponding horizontal score lines connecting the panels of the blank 304. It is noted that the front outer panel 316*b* and its flaps 320*a* and 322*a* have a full height in the vertical dimension.

Unlike the blanks in FIGS. 15 and 16, each blank in FIG. 17 is folded using a nonconventional folding sequence. In particular, after the blank in FIG. 17 is formed into an erected, open-sided rectangular sleeve of the type depicted in FIG. 7, the side closure flaps 320*a–e* are folded and glued to seal one side wall as follows. Adhesive is applied to the outer surface of the bottom minor flap 320*c* and to the inner surfaces of the inner and outer front major flaps 320*b* and 320*a*. No adhesive is applied to the portion of the outer front major flap 320*a* which is overlapped by the inner front major flap 320*b*. Adhesive is also applied to the inner surface of the top minor flap 320*e*. The side closure flaps 320*a–e* are then folded inward by 90 degrees in the following sequence: bottom minor flap 320*c*, back major flap 320*d*, inner and outer front major flaps 320*b* and 320*a*, and top minor flap 320*e*. The side closure flaps 322*a–e* are folded and glued to seal the other side wall of the carton in similar fashion. Further information concerning the manner in which the blank in FIG. 17 is formed into a carton may be obtained from U.S. Pat. Nos. 5,154,343 and 5,161,734, which are fully incorporated herein by reference.

Figure 18:
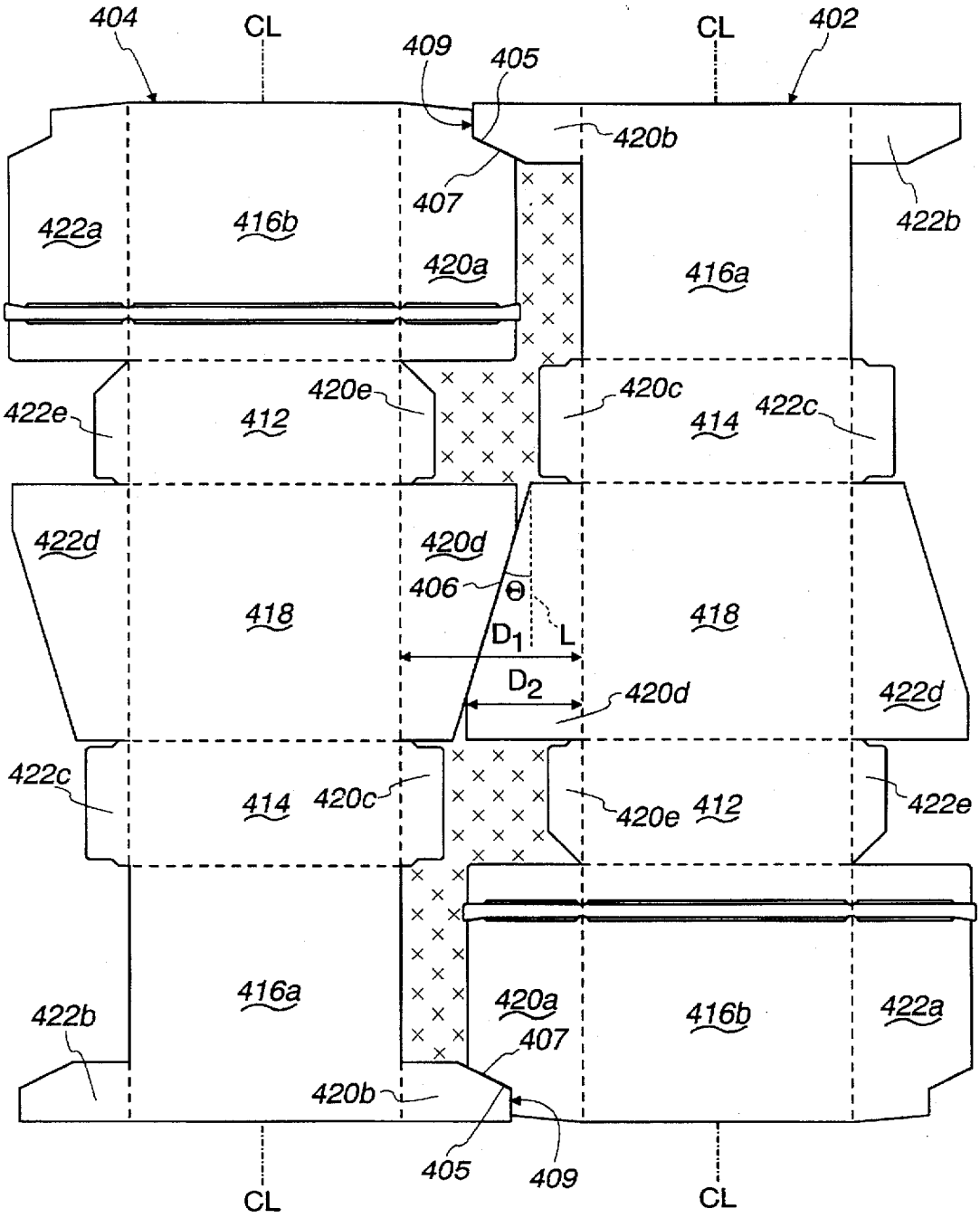
FIG. 18 is a plan view of the inside surface of a modified pair of nested blanks embodying the present invention.

Referring now to FIG. 18, there is shown yet another modified pair of oppositely-directed, identical nested blanks 402 and 404. Each of the blanks 402 and 404 includes first side closure flaps 420*a–e* and second side closure flaps 422*a–e*. The side closure flaps 420*a*, 420*d*, and 420*b* of the blank 402 are nested with the side closure flaps 420*a*, 420*d*, and 420*b* of the blank 404.

Specifically, a left vertical edge and an angled edge 405 of the partial-height inner front major flap 420*b* of the blank 402 abut a respective upper right vertical edge and an angled edge 407 of the full-height outer front major flap 420*a* of the blank 404. A left angled edge 406 of the back major flap 420*d* of the blank 402 abuts a right angled edge 406 of the back major flap 420*d* of the blank 404. A lower left vertical edge and an angled edge 407 of the outer front major flap 420*a* of the blank 402 abut a respective right vertical edge and an angled edge 405 of the inner front major flap 420*b* of the blank 404.

The side closure flaps 420*a–e* of each blank are hingedly connected to the panels thereof along vertical score lines 408. When the blanks 402 and 404 are nested, a horizontal distance $D_1$ between the vertical lines 408 of the blank 402 and the vertical score lines 408 of the blank 404 is necessarily less than twice a horizontal dimension $D_2$ of the side closure flap or flaps having the largest horizontal dimension. In this case, the side closure flaps having the largest horizontal dimension are the inner front major flap 420*b*, the back major flap 420*d*, and the outer front major flap 420*a*. These three side closure flaps have substantially the same horizontal dimension $D_2$. Advantageous features of each blank in FIG. 18 include the angled edge 406 of the back major flap 420*d* and the cutout section 409 of the outer front major flap 420*a*. The angled edge 406 reduces the surface area of each blank and allows the blanks to be formed closer to one another, thereby reducing the dead areas "X". In the illustrated embodiment, the angled edge 406 forms an angle θ in of approximately 15 to 25 degrees relative to the vertical line L. This angle θ can vary greatly depending on the amount of vertical offset between the flaps 420*d* of the respective blanks 402 and 404. The cutout section 409 insures that the inner and outer front major flaps 420*b* and 420*a* of each blank do not overlap each other when the angled edges 406 of the respective blanks 402 and 404 border on each other. Furthermore, this cutout section 409 allows the outer front major flap 420*a* to accommodate the full-width inner front major flap 420*b*.

The blanks 402 and 404 in FIG. 18 are not vertically offset (staggered) relative to each other. Rather, the blanks 402 and 404 are aligned such that horizontal score lines connecting the panels of the blank 402 are in line with corresponding horizontal score lines connecting the panels of the blank 404. It is noted that the front outer panel 416*b* and its flaps 420*a* and 422*a* have a full height in the vertical dimension. Each blank in FIG. 18 is folded and glued into a carton using the same nonconventional folding sequence described above in connection with FIG. 17.

Figure 19:
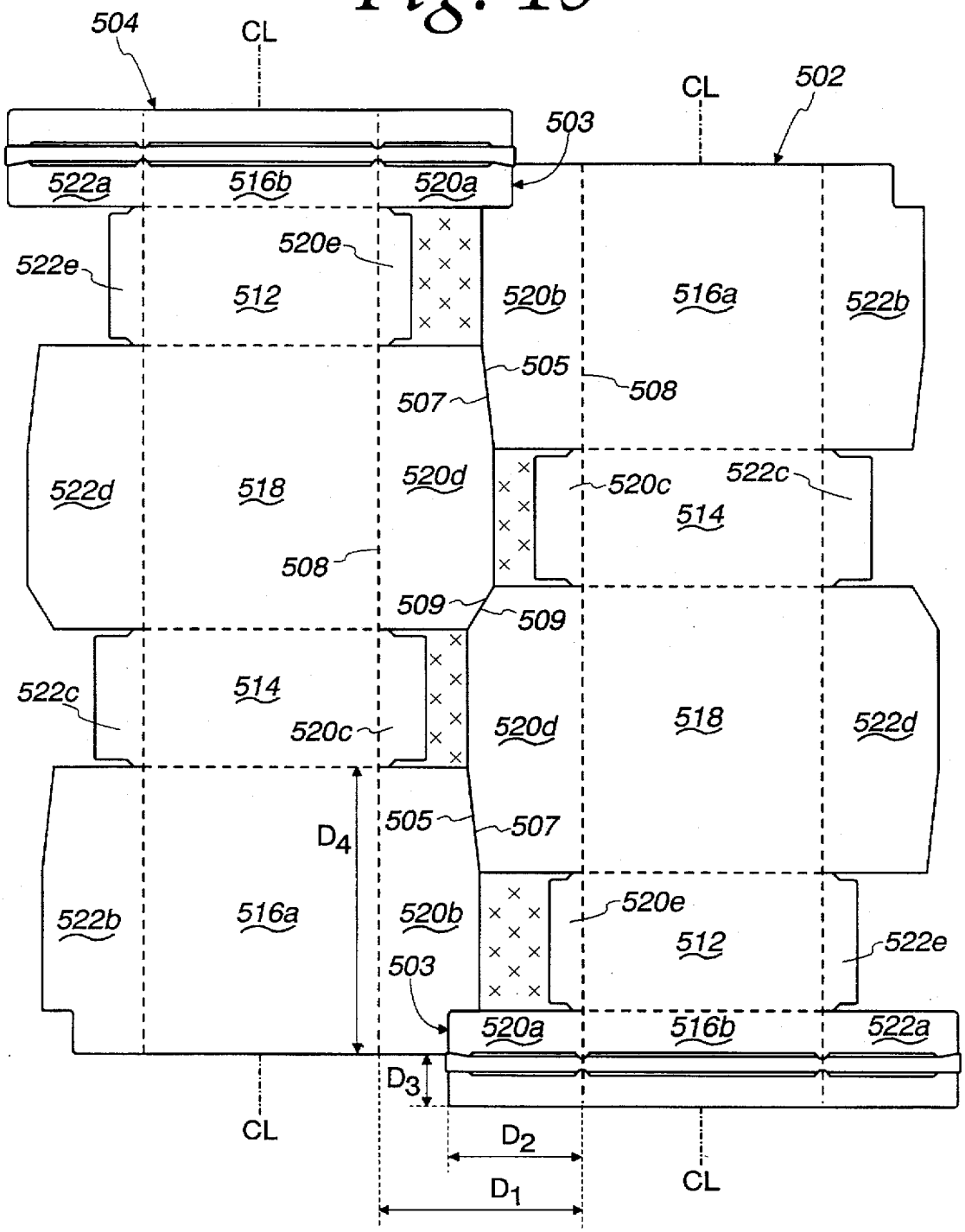
FIG. 19 is a plan view of the inside surface of a modified pair of nested blanks embodying the present invention.

FIG. 19 depicts a further modified pair of oppositely-directed, identical nested blanks 502 and 504. Each of the blanks 502 and 504 includes first side closure flaps 520*a–e* and second side closure flaps 522*a–e*. The side closure flaps 520*a*, 520*d*, and 520*b* of the blank 502 are nested with the side closure flaps 520*a*, 520*d*, and 520*b* of the blank 504. To permit nesting of the blanks 502 and 504, these side closure flaps are provided with more elaborate profiles than the side closure flaps of the previously described blanks.

Specifically, the full-height inner front major flap 520*b* of the blank 502 is provided with a cutout section 503 which accommodates the partial-height outer front major flap 520*a* of the blank 504. This cutout section 503 allows an upper left vertical edge and an intersecting horizontal edge of the inner front major flap 520*b* of the blank 502 to abut a respective lower right vertical edge and lower horizontal edge of the outer front major flap 520*a* of the blank 504. Furthermore, the inner front major flap 520*b* of the blank 502 includes a slightly angled, lower left edge 505 which abuts a slightly angled upper right edge 507 of the partial-width back major flap 520*d* of the blank 504. An angled upper edge 509 of the back major flap 520*d* of the blank 502 abuts an angled lower edge 509 of the back major flap 520*d* of the blank 504. A slightly angled, low left edge 507 of the back major flap 520*d* of the blank 502 abuts a slightly angled, upper right edge 505 of the inner front major flap 520*b* of the blank 504. The partial-height outer front major flap 520*a* of the blank 502 nests with the full-height inner front major flap 520*b* of the blank 504 due to the cutout section 503 in the blank 504.

The side closure flaps 520*a–e* of each blank are hingedly connected to the panels thereof along vertical score lines 508. When the blanks 502 and 504 are nested, a horizontal distance $D_1$ between the vertical lines 508 of the blank 502 and the vertical score lines 508 of the blank 504 is necessarily less than twice a horizontal dimension $D_2$ of the side closure flap or flaps having the largest horizontal dimension. In this case, the side closure flap having the largest horizontal dimension is the outer front major flap 520*a*. Advantageous features which facilitate nesting of the blanks 502 and 504 include the cutout section 503 and angled edges 505,507 and 509.

Like the blanks in FIG. 15, the blanks 502 and 504 in FIG. 19 are vertically offset (staggered) relative to each other by a vertical distance $D_3$. This vertical distance $D_3$ is preferably less than a vertical dimension $D_4$ of the side closure flap or flaps having the largest vertical dimension. In this case, the side closure flaps having the largest vertical dimension are the inner front major flap 520*b* and the back major flap 520*d*. These two side closure flaps have approximately the same vertical dimension $D_4$.

Each blank in FIG. 19 is folded and glued into a carton using the same nonconventional folding sequence described above in connection with FIG. 17. It is noted that the front outer panel 516*b* and the outer front major flaps 520*a* and 522*a* have a partial height in the vertical dimension. To compensate for the partial-height outer front major flaps 520*a* and 522*a*, the inner front major flaps 520*b* and 522*b* have a full height in the vertical dimension.

Figure 20:
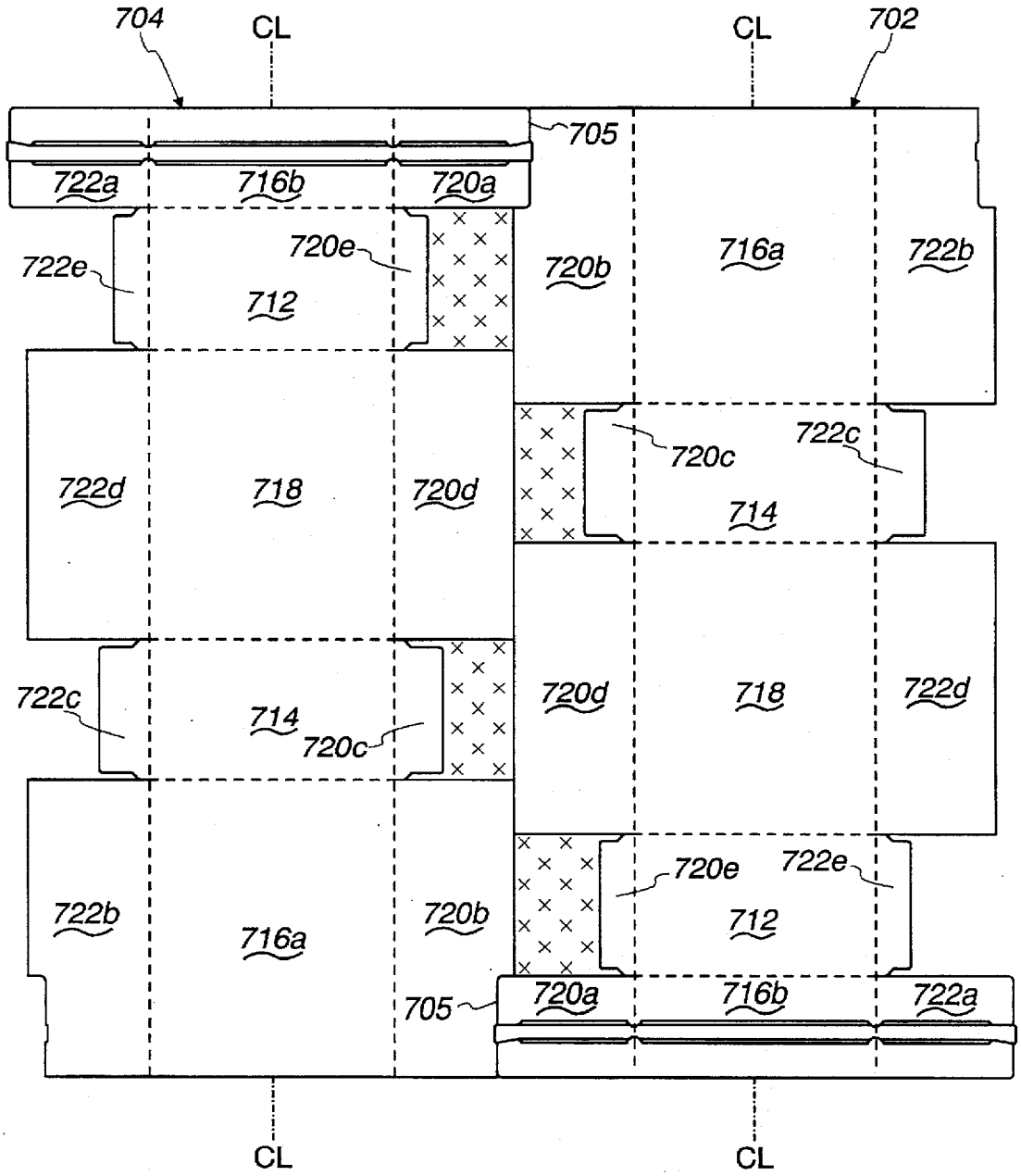
FIG. 20 is a plan view of the inside surface of a modified pair of nested blanks embodying the present invention.

FIG. 20 illustrates a modified pair of oppositely-directed, identical nested blanks 702 and 704. The blanks 702 and 704 are nested to a lesser degree than the blanks in FIGS. 15–19. The inner front major flap 720*b* of the blank 702 includes a cutout section 705 which accommodates the partial-height outer front major flap 720*a* of the blank 704. The blanks 702 and 704 include full-height inner front major flaps 720*b* and 722*b*, partial-height outer front major flaps 720*a* and 722*a*, and a partial-height outer front panel 716*b*. Additionally, the blanks 702 and 704 include partial-width inner front major flaps 720*b* and 722*b*, full-width outer front major flaps 720*a* and 722*a*, and partial-width back major flaps 720*d* and 722*d*. The blanks 702 and 704 in FIG. 21 are each folded into a carton using the nonconventional folding sequence described in connection with FIG. 17.

It can be seen that the various blanks in FIGS. 15–20 accomplish nesting by manipulating the profiles, widths, and heights of the inner front major flaps (wing flaps), the outer front major flaps, and the back major flaps. Further, nesting is accomplished by varying the degree of vertical offset between oppositely-directed, identical blanks. Without regard to any locking flaps which might be included in the blank, some of the embodiments utilize approximately no vertical offset (see FIGS. 16, 17, 18, and 20) while other embodiments utilize a readily apparent vertical offset (see FIGS. 15 and 19). Such nesting can be achieved whether the situation calls for a full- or partial-height outer front panel, full- or partial-height outer front major flaps, full- or partial-height inner front major flaps, full- or partial-width inner front major flaps, and full- or partial-width back major flaps.

A full-height outer front panel might be desired in order to provide unbroken graphics on the front wall of the carton (see FIGS. 15, 16, 17, 18). Such a full-height outer front panel is typically connected to full-height outer front major flaps in order to provide the carton with top load compression strength. The full-height outer front major flaps may be provided with cutout sections if unbroken graphics on the side walls is not necessary (see FIGS. 17, 18). When the outer front major flaps have a full height, the inner front major flaps preferably have a partial height.

A partial-height outer front panel might be acceptable in situations where there is no need for unbroken graphics on the front wall of the carton (see FIGS. 19 and 20). Such a partial-height outer front panel is typically connected to partial-height outer front major flaps. To compensate for the partial-height outer front major flaps, the inner front major flaps must extend for the full height of the carton so that the side walls of the carton are complete.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A nested blank arrangement, comprising:

first and second unitary, continuous blanks each for forming a side-filled, flip-top reclosable carton having opposing top and bottom walls, opposing front and back walls, and opposing first and second side walls, each of said blanks including at least five panels hingedly connected to each other along generally horizontal fold lines, each of said panels including opposing first and second vertical edges, said panels including inner and outer front panels for forming said front wall, a back panel for forming said back wall, a top panel for forming said top wall, and a bottom panel for forming said bottom wall, said inner front panel being connected to the bottom panel, said bottom panel being connected to said back panel, said back panel being connected to said top panel, and said top panel being connected to said outer front panel, and first and second side closure flaps hingedly connected to each of said panels along said respective first and second vertical edges, said first and second side closure flaps cooperating to form said opposing first and second side walls of said carton; and said first blank being vertically oriented in a first direction, said second blank being vertically oriented in a second direction opposite to said first direction, said first and second blanks being horizontally adjacent to each other, one or more of said first side closure flaps of said first blank horizontally nesting with and bordering on one or more of said first side closure flaps of said second blank such that a horizontal distance between said first vertical edges of said first blank and said first vertical edges of said second blank is less than twice a horizontal dimension of the first side closure flap having a largest horizontal dimension.

2. The nested blank arrangement of claim 1, wherein said first and second blanks are vertically offset relative to each other by a vertical distance which is less than a vertical dimension of the first side closure flap having a largest vertical dimension.

3. The nested blank arrangement of claim 1, wherein each of said first and second blanks is symmetrical about a vertical axis of symmetry.

4. The nested blank arrangement of claim 1, wherein said first and second side closure flaps include respective first and second inner front major flaps hingedly connected to said inner front panel, respective first and second bottom minor flaps hingedly connected to said bottom panel, respective first and second back major flaps hingedly connected to said back panel, respective first and second top minor flaps hingedly connected to said top panel, and respective first and second outer front major flaps hingedly connected to said outer front panel.

5. The nested blank arrangement of claim 4, wherein said first outer front major flap of said first blank includes a cutout section and said first inner front major flap of said second blank is located in said cutout section and borders on said first outer front major flap of said first blank.

6. The nested blank arrangement of claim 4, wherein said first inner front major flap of said first blank includes a cutout section and said first outer front major flap of said second blank is located in said cutout section and borders on said first inner front major flap of said first blank.

7. The nested blank arrangement of claim 4, wherein said first back major flaps of said respective first and second blanks each include an angled edge, said angled edge of said first back major flap of said first blank bordering on and nesting with said angled edge of said first back major flap of said second blank.

8. The nested blank arrangement of claim 7, wherein said first back major flap has a vertical dimension, said angled edge extending for a substantial portion of said vertical dimension.

9. The nested blank arrangement of claim 4, wherein said first inner front major flap of said first blank borders on said first outer front major flap of said second blank.

10. The nested blank arrangement of claim 9, wherein said first inner front major flap of said first blank nests with said first outer front major flap of said second blank.

11. The nested blank arrangement of claim 4, wherein said first inner front major flap of said first blank borders on said first back major flap of said second blank.

12. The nested blank arrangement of claim 11, wherein said first inner front major flap of said first blank nests with said first back major flap of said second blank.

13. The nested blank arrangement of claim 4, wherein said carton has a height approximately equal to a distance between said top and bottom walls, wherein said outer front panel and said first and second outer front major flaps are sized to extend for only a portion of said height, and wherein said first and second inner front major flaps are sized to extend for substantially all of said height.

14. The nested blank arrangement of claim 4, wherein said carton has a height approximately equal to a distance between said top and bottom walls, wherein said outer front panel and said first and second outer front major flaps are sized to extend for substantially all of said height, and wherein said first and second inner front major flaps are sized to extend for only a portion of said height.

15. The nested blank arrangement of claim 4, wherein said carton has a width approximately equal to a distance between said front and back walls, wherein said first and second inner front major flaps are sized to extend for substantially all of said width.

16. A nested blank arrangement, comprising:

first and second unitary, continuous identical blanks, each of said first and second blanks being configured to form a side-filled, flip-top reclosable carton having opposing top and bottom walls, opposing front and back walls, and opposing first and second side walls, each of said first and second blanks including at least five panels hingedly connected to each other along generally horizontal fold lines, each of said panels including opposing first and second vertical edges, each of said first and second blanks including first and second side closure flaps hingedly connected to said panels along said respective first and second vertical edges; and said first and second blanks being vertically oriented in opposite directions and being horizontally adjacent to each other, one or more of said first side closure flaps of said first blank horizontally nesting with and bordering on one or more of said first side closure flaps of said second blank.

17. The nested blank arrangement of claim 16, wherein said first and second blanks are vertically offset relative to each other by a vertical distance which is less than a vertical dimension of the first side closure flap having a largest vertical dimension.

18. The nested blank arrangement of claim 16, wherein each of said first and second blanks is symmetrical about a vertical axis of symmetry.

19. The nested blank arrangement of claim 16, wherein one of said first side closure flaps includes an angled edge, said angled edge of said one of said first side closure flaps of said first blank bordering on and nesting with said angled edge of said one of said first side closure flaps of said second blank.

* * * * *